US007043944B2

(12) United States Patent
Park et al.

(10) Patent No.: US 7,043,944 B2
(45) Date of Patent: May 16, 2006

(54) DRUM TYPE WASHING AND DRYING APPARATUS

(75) Inventors: Young-Hwan Park, Gyeonggi-Do (KR); Kyung-Seop Hong, Incheon (KR); Choon-Myun Chung, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 298 days.

(21) Appl. No.: 10/687,596

(22) Filed: Oct. 20, 2003

(65) Prior Publication Data

US 2005/0081576 A1 Apr. 21, 2005

(51) Int. Cl.
*D06F 39/04* (2006.01)

(52) U.S. Cl. ..... 68/20; 68/19.1

(58) Field of Classification Search ..... 68/20, 68/19.1, 24, 58, 142
See application file for complete search history.

(56) References Cited

U.S. PATENT DOCUMENTS

| | | | | |
|---|---|---|---|---|
| 2,750,779 | A * | 6/1956 | Whyte | 68/19 |
| RE25,784 | E * | 5/1965 | Robbins | 68/4 |
| 3,220,230 | A * | 11/1965 | Jacobs et al. | 68/19.2 |
| 3,323,336 | A * | 6/1967 | Johnson et al. | 68/18 R |
| 4,275,510 | A * | 6/1981 | George | 34/90 |
| 4,891,892 | A * | 1/1990 | Narang | 34/86 |
| 5,628,122 | A * | 5/1997 | Spinardi | 34/79 |
| 6,671,978 | B1 * | 1/2004 | McGowan et al. | 34/596 |
| 2003/0115682 | A1 * | 6/2003 | Gardner | 8/159 |
| 2004/0083772 | A1 * | 5/2004 | Gaines | 68/19 |

FOREIGN PATENT DOCUMENTS

| | | |
|---|---|---|
| EP | 1029961 | 8/2000 |
| FR | 2 635 539 | * 2/1990 |
| JP | 61-234897 | * 10/1986 |
| JP | 3-57489 | * 3/1991 |

* cited by examiner

*Primary Examiner*—Frankie L. Stinson
(74) *Attorney, Agent, or Firm*—Greenblum & Bernstein, P.L.C.

(57) ABSTRACT

A drum type washing and drying apparatus comprising: a washing unit including a tub receiving a water for washing laundry and a first drum rotatably installed inside the tub; a drying unit including a second drum rotatably installed in the vicinity of the washing unit; a first airflow duct of which one end is connected to the inside of the tub and the other end is connected to the second drum; a blowing fan installed at the first airflow duct for introducing an air inside the tub into the second drum through the first airflow duct; a heating means for heating the air passing through the first airflow duct; and a second airflow duct of which one end is connected to the second drum and the other end is connected to the tub so that the air inside the second drum is introduced into the tub therethrough, thereby improving drying performance thereof and reducing fabrication costs and noise.

9 Claims, 6 Drawing Sheets

DRUM TYPE WASHING AND DRYING APPARATUS

BACKGROUND OF THE INVENTION

1. Field of the Invention

The present invention relates to a drum type washing and drying apparatus, more particularly, to a drum type washing and drying apparatus capable of improving drying performance and reducing manufacturing costs and noise.

2. Description of the Conventional Art

Lately, there has been an increase in use of a drying machine as well as a washing machine so as to reduce a time for washing and drying laundry.

A washing machine has an electric motor for a main power source, and eliminates dirt of the laundry by receiving laundry, detergent and water in a washing tub and performing washing, rinsing and dewatering operations so that the laundry, detergent and water can interact. A drying apparatus eliminates moisture contained in clothing, which has been washed, by introducing heated air into a drying tub in which the laundry has been received.

FIG. 1 is a perspective view illustrating a washing machine and a drying machine in accordance with the conventional art. As shown, the washing machine 111 and the drying machine 131 are disposed abreast at mutually adjacent location so as to easily performing washing and drying operations.

As shown in FIG. 2, the washing machine 111 comprises a casing 113 including a receiving space at its inside and a door 115 which is installed at its front surface to open and close a gateway through which the laundry comes in and out; a tub 117 disposed in the casing 113 and receiving water for washing the laundry; and a washing drum 123 installed in the tub 117 so that rotary shaft 112 of the drum 123 is disposed horizontally; a drum driving motor 125 installed at a rear side of the tub 115, connected to the rotary shaft 112 of the washing drum 123, and providing a rotating force for driving the washing drum 123. The washing machine 111 also comprises a spring 119 and a damper 121 installed at upper and lower sides of the tub 117, respectively, for elastically supporting the tub 117; and a draining duct 120 and a draining pump 122 installed at a lower side of the tub 117 so that water can drain.

As shown in FIG. 3, the drying machine 131 comprises a casing 133 including a door 134, which is installed at its front surface to open and close a gateway through which clothing to be dried comes in and out; a drying drum 135 rotatably installed in the casing 133; an air flowing duct 137 of which one end is connected to a rear side of the drying drum 135 and the other end is connected to a front side of the drying drum 135, a blowing fan 139 disposed at the air flowing duct 137 for circulating air through the air flowing duct 137; a driving motor 141 for driving the drying drum 135 and the blowing fan 139; a heater 143 disposed at a rear side of the drying drum 135, and heating air flowing along the air flowing duct 137 before the air is introduced into the rotating drum 135; a condenser 145 for condensing air containing moisture of the laundry; and a cooling fan 147 for cooling the condenser 145.

By the construction above, when the laundry washed and dewatered by the washing machine 111 is received in the drying drum 135 of the drying machine 131, a power is applied to the driving motor 141, the drying drum 135 and the blowing fan 139 start to drive. And, air inside the drying drum 135 is circulated toward a rear side of the drying drum 135 through the air flowing duct 137 by operating of the blowing fan 139, and is heated by the heater 143 before being introduced into the rotating drum 135.

The heated air of high temperature contains moisture evaporated from the clothing or the like in the drying drum 135, and is sucked into the air flowing duct 137 again. The moisture sucked with the air of high temperature is condensed and discharged while going by way of the condenser 145. The dried air flows along the air flowing duct 137, is heated by the heater 143, and then introduced into the rotating drum 135. The process above is repeatedly performed, and this repeated process performs a drying operation.

However, in the conventional drying machine 131, drying performance is relatively low. Also, since the condenser 145 and the cooling fan 147 which are relatively expensive are needed, manufacturing costs of the drying machine 131 are increased, and noise is generated during driving of the cooling fan 147 for cooling the condenser 145.

SUMMARY OF THE INVENTION

Therefore, an object of the present invention is to provide a drum type washing and drying apparatus capable of improving drying performance, reducing manufacturing costs and preventing an unnecessary noise.

To achieve these and other advantages and in accordance with the purpose of the present invention, as embodied and broadly described herein, there is provided a drum type washing and drying apparatus comprising a washing unit including a tub receiving a water for washing laundry and a first drum rotatably installed inside the tub; a drying unit including a second drum rotatably installed in the vicinity of the washing unit; a first airflow duct of which one end is connected to the inside of the tub and the other end is connected to the second drum; a blowing fan installed at the first airflow duct for introducing an air inside the tub into the second drum through the first airflow duct; a heating means for heating the air passing through the first airflow duct; and a second airflow duct of which one end is connected to the second drum and the other end is connected to the tub so that the air inside the second drum is introduced into the tub therethrough.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute an unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
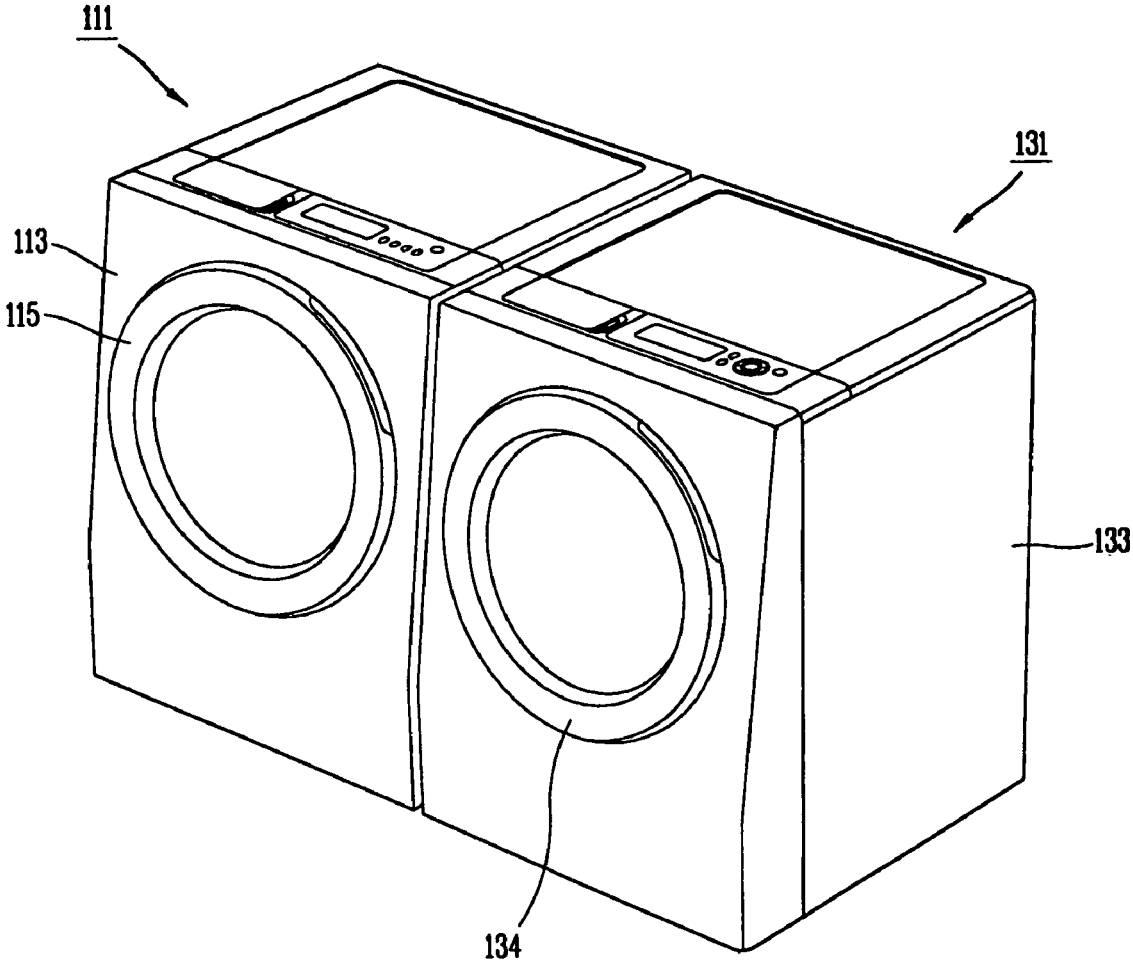
FIG. 1 CONVENTIONAL ART
FIG. 1 is a perspective view illustrating a washing machine and a drying machine according to the conventional art.
Figure 2:
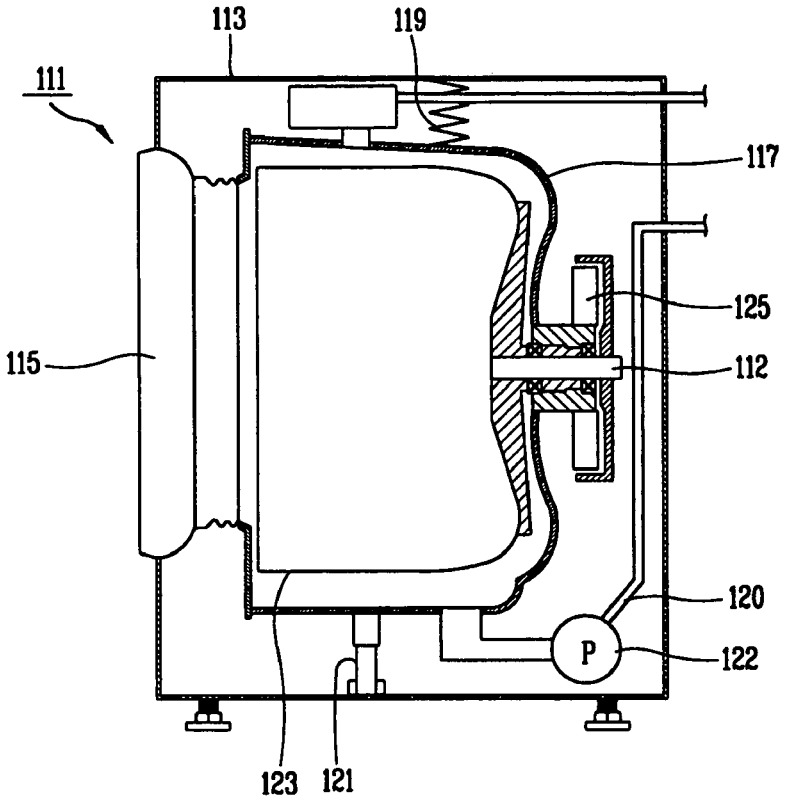
FIG. 2 CONVENTIONAL ART
FIG. 2 is a schematic view illustrating a washing machine according to the conventional art.
Figure 3:
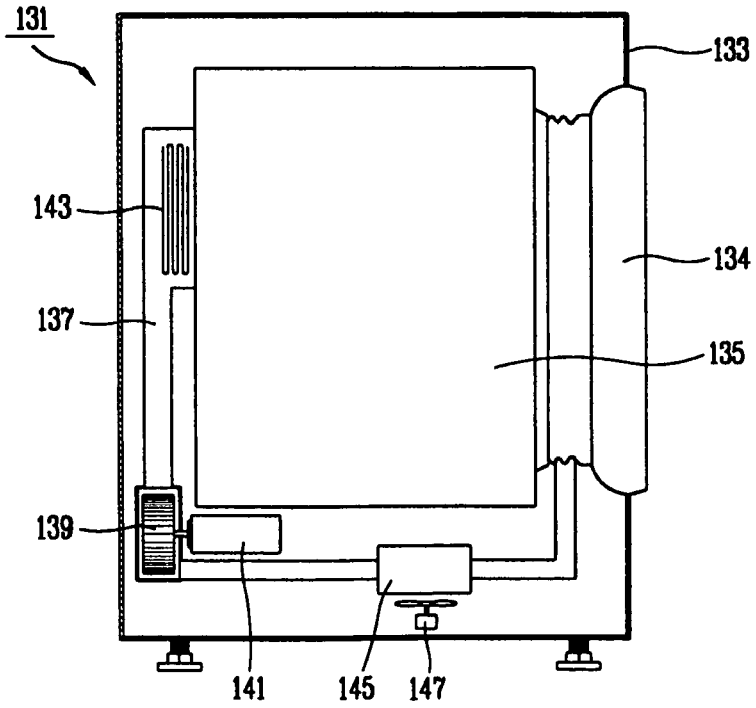
FIG. 3 CONVENTIONAL ART
FIG. 3 is a schematic view illustrating a drying machine according to the conventional art.
Figure 4:
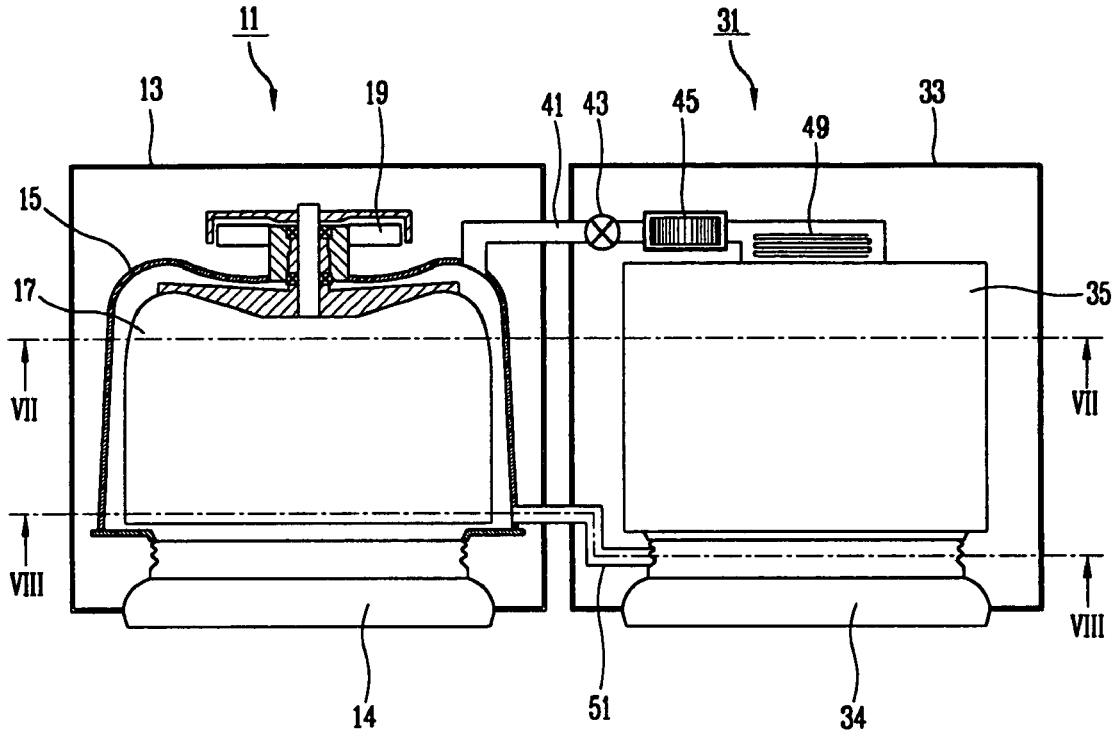
FIG. 4 is a sectional view illustrating a drum type washing and drying apparatus according to one embodiment of the present invention.

As shown in FIG. 4, A drum type washing and drying apparatus according to one embodiment of the present invention includes a washing unit 11 for washing and dewatering the laundry; a drying unit 31 for drying the laundry washed in the washing unit 11; and a control unit for controlling the washing unit 11 and the drying unit 31. Also, the washing unit 11 and the drying unit 31 is communicated with each other by a first airflow duct 41 through which an air in the washing unit 11 passes toward the drying unit 31, and a second airflow duct 51 through which an air in the drying unit 31 passes toward the washing unit 11.

Figure 5:
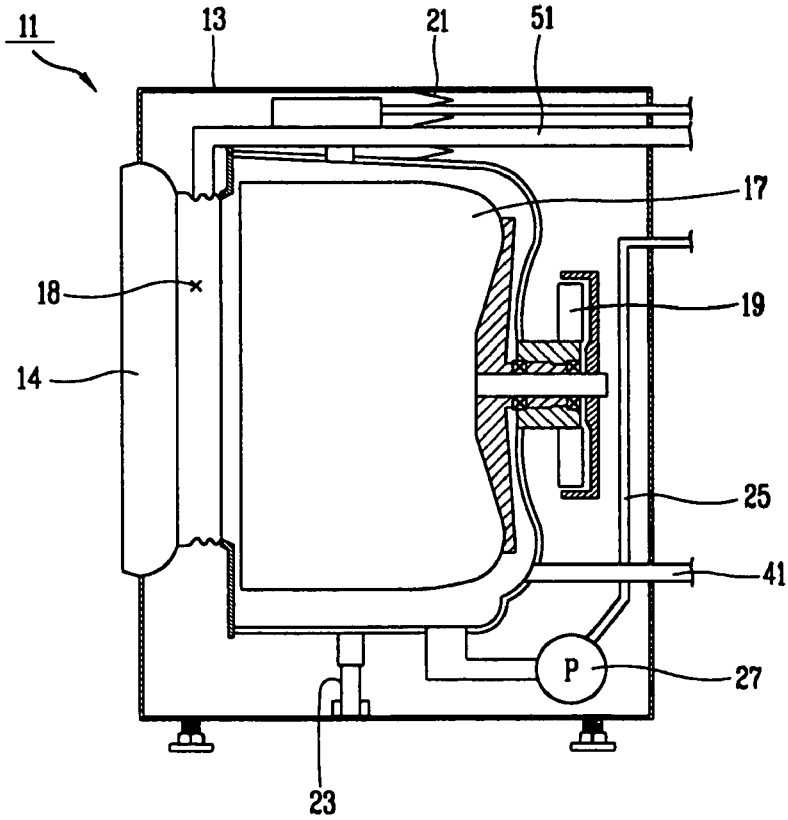
FIG. 5 is a sectional view illustrating a washing unit of a drum type washing and drying apparatus according to one embodiment of the present invention.

As shown in FIG. 5, the washing unit 11 comprises a first casing 13 having a receiving space therein and a door 14 at a front side thereof; a tub 15 disposed in the first casing 13 for receiving water therein; a first drum 17 rotatably disposed in the tub 15; a first driving motor 19 for rotating the first drum 17; a spring 21 and a damper 23 respectively installed at upper and lower sides of the tub 15 for elastically supporting the tub 15; and a draining duct 25 and a draining pump 27 disposed at a lower side of the tub 15 so that water can drain. Here, the first airflow duct 41 is connected to an inside of the tub 15 at a lower side of the tub 15, and the second airflow duct 51 is connected to an opening portion 18 of the tub 15 at an upper side of the tub 15.

Figure 6:
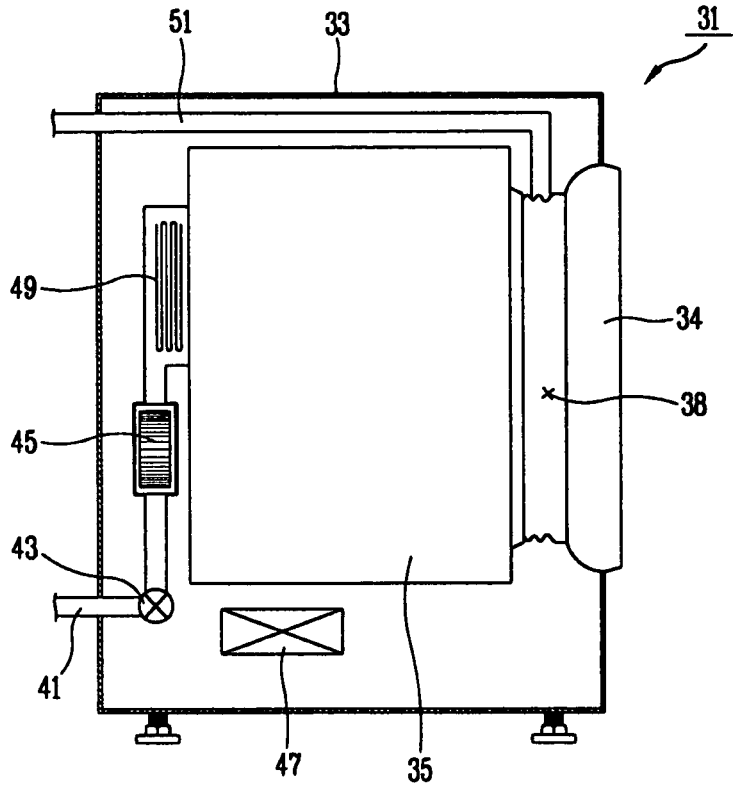
FIG. 6 is a sectional view illustrating a drying unit of a drum type washing and drying apparatus according to one embodiment of the present invention.

As shown in FIG. 6, the drying unit 31 comprises a second casing 33 having a receiving space therein and a door 34 at a front side thereof; a second drum 35 rotatably disposed in the second casing 33; a second driving motor 47 for rotating the second drum 35. The driving unit 31 also comprises a blowing fan 45 installed at the first airflow duct 41 which communicates with an inside of the second drum 35, for introducing an air withdrawn from the tub 15 of the washing unit 11 into the second drum 35 of the drying unit 31; a heater 49 installed at a rear side of the second drum 35 for heating an air before being introduced into the second drum 35. Herein, preferably, the blowing fan 45 and the second drum 35 are configured to be driven by one motor.

Figure 7:
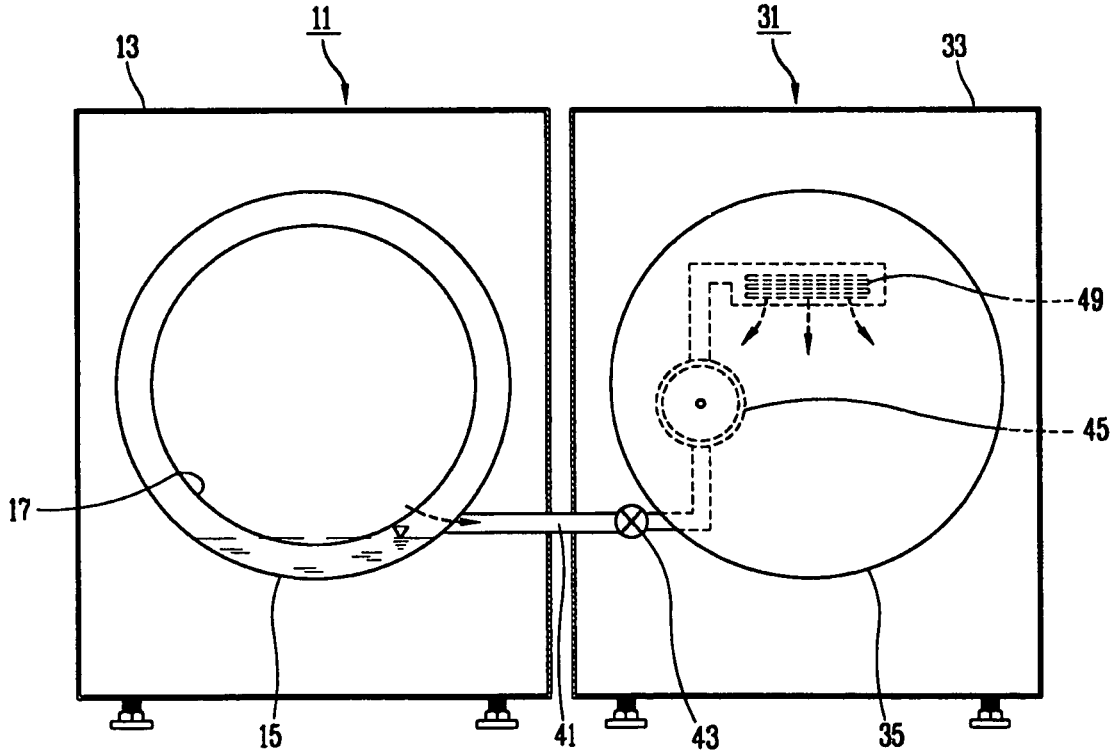
FIG. 7 is a cross sectional view taken along line VII—VII in FIG. 4.
Figure 8:
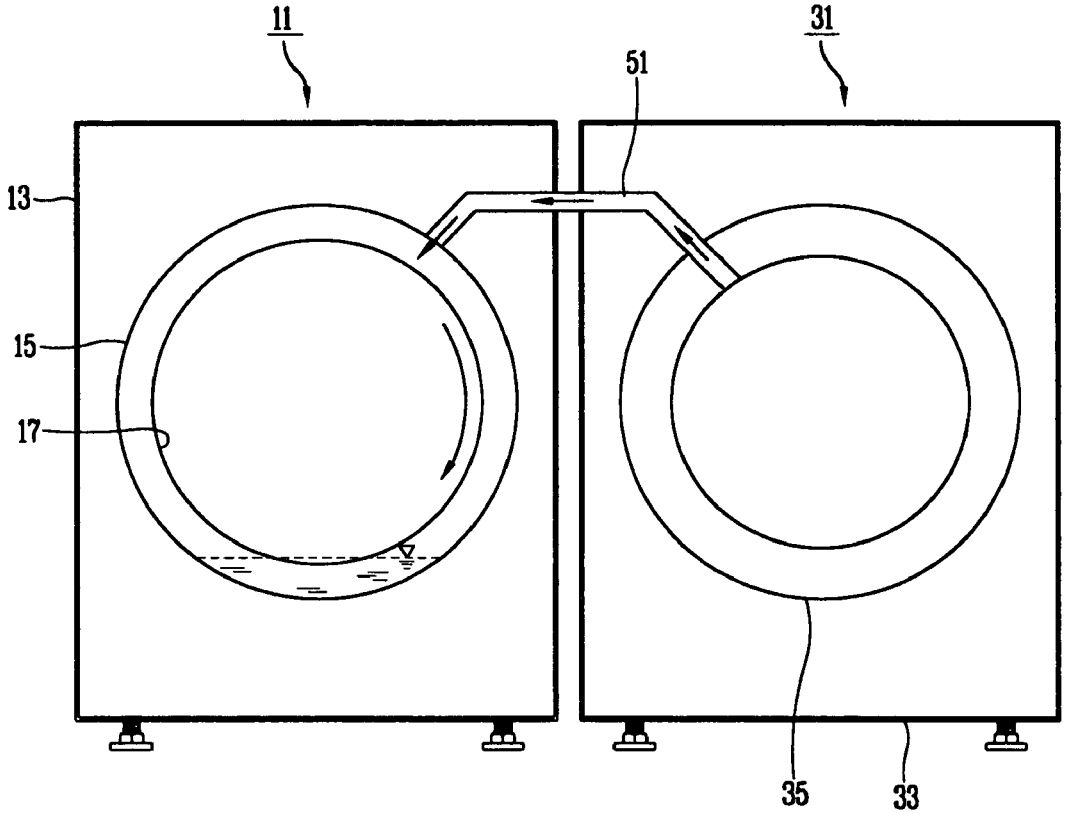
FIG. 8 is a cross sectional view taken along line VIII—VIII in FIG. 4.

As shown in FIGS. 7 and 8, an airflow valve 43 installed at the first airflow duct 41 for opening or closing the first airflow duct 41. The second airflow duct 51 is communicated to an opening portion 38 of the second drum 35 at an upper side of the second drum 35. Meanwhile, it is preferred that the first airflow duct 41 and the second airflow duct 51 are made of a rubber member, a soft synthetic material or the like so as to prevent vibration generated at the washing unit 11 and the drying unit 31 from being intertransmitted to each other.

Figure 9:
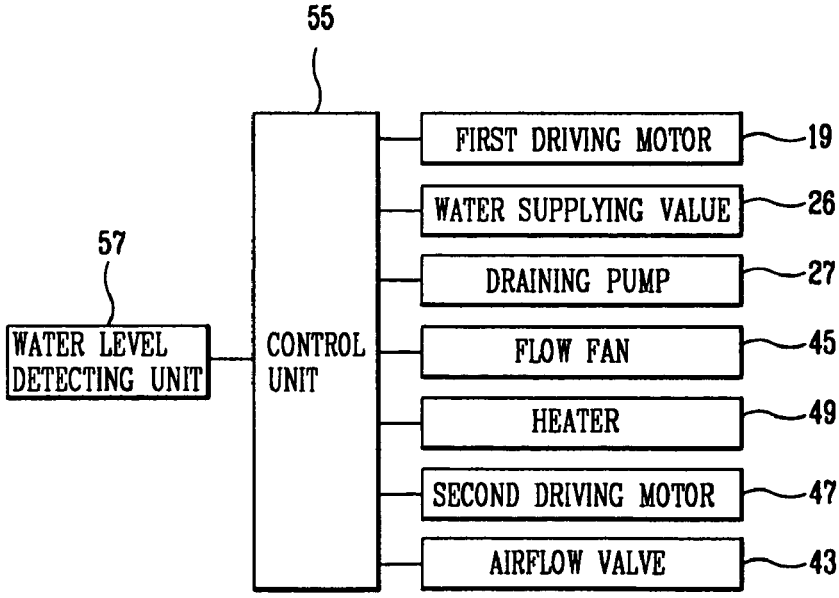
FIG. 9 is a control block diagram of a drum type washing and drying apparatus according to the present invention.

As shown in FIG. 9, the control unit 55 having a microcomputer contained a built-in control program controls the first and second driving motor 19 and 47, the blowing fan 45, the heater 49 and the airflow valve 43 during the washing and drying operation. Further, the control unit 55 is connected to a water level detecting unit 57 for detecting water level in the tub 15, and the control unit 55 controls a water supply valve which regulates an amount of water being introduced into the tub 15 and the draining pump 27, for controlling water level in the tub 15 on the basis of the water level detecting unit 57.

Processes that the drum type washing and drying apparatus of one embodiment of the present invention is operated will be explained, as follows.

Firstly, before a washing operation is started at a washing unit 11, the control unit 55 controls the airflow valve 43 so as to cut off the first airflow duct 41. When a dewatering operations is performed after the washing operation is completed, the control unit 55 controls the draining pump 27 on the basis of a detecting result of the water level detecting unit 27 so that water can remain in the tub 15 in a degree that the first drum 17 can rotate without contacting with the water in the tub 15.

Further, when the dewatering operation is terminated, dewatered clothing or the like is received in the second drum 35, and then a drying operation is started, the control unit 55 opens the water supplying valve 26 so as to additionally supply water in a degree that the first drum 17 is slightly sunk under water, and controls the airflow valve 43 so that the first airflow duct 41 can be opened. Also, the control unit 55 controls the blowing fan 45, the first and second driving motor 19, 47 and the heater 49 so as to be driven respectively.

Also, when the blowing fan 45 starts to drive, the air withdrawn from the tub 15 flows along the first airflow duct 41, the air is heated by the heater 49, and then the air is introduced into the second drum 35. The introduced air of high temperature contains moisture evaporated from the clothing or the like rotating in the second drum 35, is discharged outside the second rotating drum 35, flows along the second airflow duct 51, and then is introduced into the tub 15.

The air of relatively high temperature and high humidity, which is introduced into the tub 15 exchanges its heat with the first drum 17 while coming in contact with the first drum 17 rotating in contact with water. Thusly the moisture of the air is condensed. The dried air of relatively low temperature due to elimination of it moisture, flows along the first airflow duct 41, and is heated by the heater 49. The heated and dried air of high temperature is introduced into the second drum 35 again, evaporates moisture of the clothing or the like, and thus becomes in a state of high temperature and high humidity. And then, this hot and humid air flows along the second airflow duct 51 and is introduced into the tub 15. This process is repeatedly performed and thus a drying operation is performed by the repeated process.

When the drying operation is completed, the control unit 55 controls the draining pump 27 so that all water in the tub 15 can be discharged outside the tub 15. Also, the control unit 55 controls the airflow valve 43 to cut off the first airflow duct 41 so as to prevent water from being flowed into the first airflow duct 41 during washing operation.

In the drum type washing and drying apparatus according to one embodiment of the present invention, the hot and humid air generated in the drying unit can be condensed in the washing unit, thereby improving drying performance, reducing manufacturing costs and preventing an unnecessary noise.

Hereinafter, a drum type washing and drying apparatus of another embodiment of the present invention will be described with reference to FIGS. 10 and 11. The same parts as described and illustrated above, will have the same reference number, and the detail descriptions thereof will be omitted.

Figure 10:
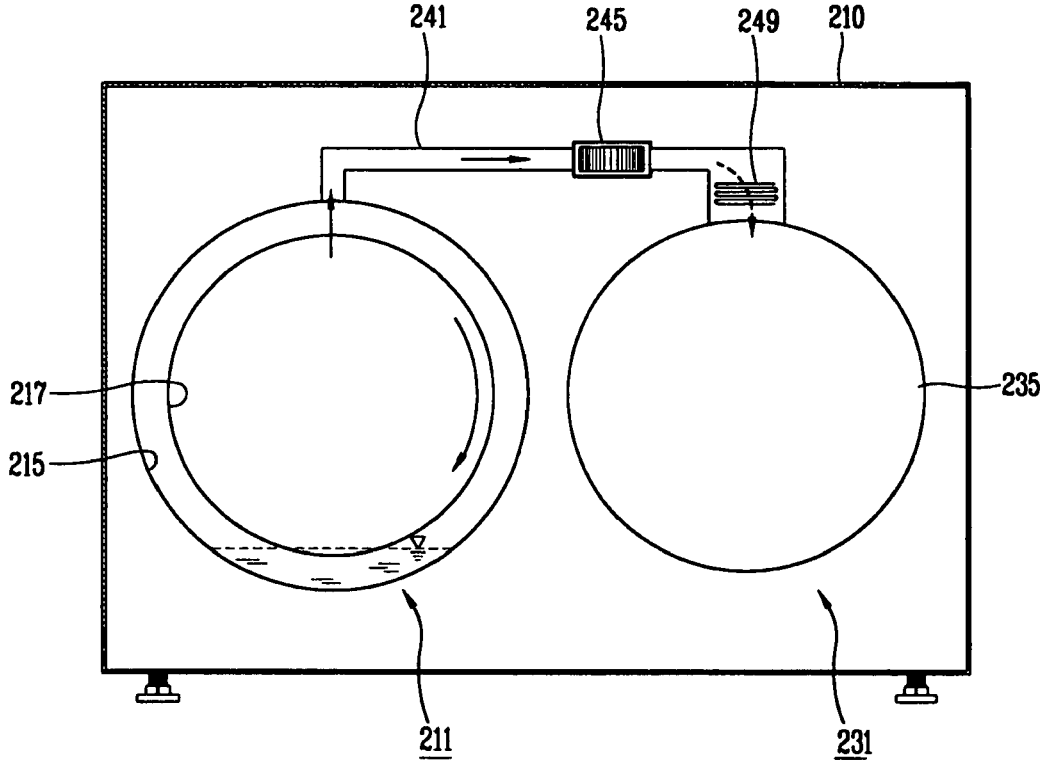
FIGS. 10 and 11 are schematic views illustrating a drum type washing and drying apparatus according to another embodiment of the present invention.
Figure 11:
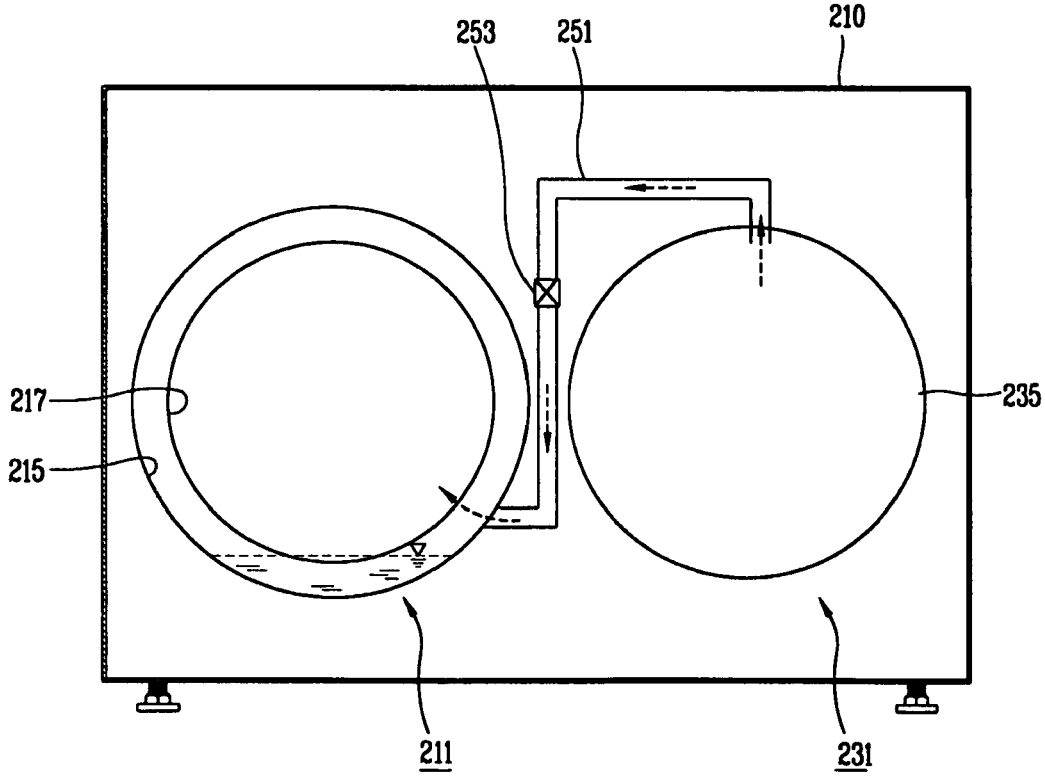

As shown in FIGS. 10 and 11, a drum type washing and drying apparatus of another embodiment of the present invention comprises a casing 210 having a receiving space therein; a washing unit 211 including a tub 215 disposed in the casing 210 for receiving a water and a first drum 217 rotatably installed inside the tub 215 for receiving and washing the laundry; a drying unit 231 including a second drum 235 rotatably installed in the vicinity of the tub 215; a first airflow duct 241 of which one end is connected to the inside of the tub 215 at an upper side of the tub 215 and the other end is connected to the second drum 235; a blowing fan 245 installed at the first airflow duct 241 for introducing an air inside the tub 215 into the second drum 235 through the first airflow duct 241; a heating means 249 for heating the air passing through the first airflow duct 241; and a second airflow duct 251 of which one end is connected to the second drum 235 at an upper side of the second drum 235 and the other end is connected to the tub 215 so that the air inside the second drum 235 is introduced into the tub 215 therethrough.

An airflow valve 253 is provided at a lower side of the second airflow duct 251 so as to open or close the second airflow duct 251, and the airflow valve 253 is electrically connected with the control unit 55.

A drying operation of the drum type washing and drying apparatus of another embodiment of the present invention is described, as follows.

Firstly, when the drying operation is started, the control unit 55 controls the airflow valve 253 so that the second airflow duct 251 can be opened, and makes the blowing fan 245, the heating means 249, and the first and the second drums 217 and 235 driven respectively. When the blowing fan 245 starts to drive, air is withdrawn from the tub 215, and the withdrawn air flows along the first airflow duct 241 and is heated by the heating means 49. The heated air of high temperature contains moisture evaporated in the second drum 235, flows along the second airflow duct 251 and then is introduced into the tub 215.

The air introduced into the tub 215 exchanges its heat with the first drum 217 while coming in contact with the first rotating drum 217 rotating in contact with water in the tub 215, and thus moisture is condensed and eliminated. The dried air of low temperature due to the elimination of its moisture, flows along the first airflow duct 241, and is heated by the heating means 249. The heated and dried air of high temperature is introduced into the second drum 235, contains moisture and then is discharged outside the second drum 235. This process is repeatedly performed, and thus a drying operation is performed by the repeated process.

In the drum type washing and drying apparatus according to another embodiment of the present invention, the hot and humid air generated in the drying unit can be condensed in the washing unit, thereby improving drying performance, reducing manufacturing costs and preventing an unnecessary noise.

In addition, in the another embodiment of the present invention, the washing unit and the drying unit are integrally installed in a single casing, thereby simplifying the structure of the drum type washing and drying apparatus and reducing manufacturing costs.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A drum type washing and drying apparatus comprising:

a washing unit including a tub receiving a water for washing laundry and a first drum rotatably installed inside the tub;

a drying unit including a second drum rotatably installed in the vicinity of the washing unit;

a first airflow duct of which one end is connected to the tub and the other end is connected to the second drum;

a blowing fan installed at the first airflow duct for introducing an air inside the tub into the second drum through the first airflow duct;

a heating means for heating the air passing through the first airflow duct; and a second airflow duct of which one end is connected to the second drum and the other end is connected to the tub so that an air inside the second drum is introduced into the tub therethrough.

2. The apparatus of claim 1, further comprising a control unit installed at the washing unit for controlling a water supply valve and a draining pump so that the first drum can be in contact with water inside the tub when the second drum performs a drying operation.

3. The apparatus of claim 2, further comprising a water level detecting unit for detecting a water level in the tub, and the control unit controls the water supply valve and the draining pump on the basis of the water level detecting unit.

4. The apparatus of claim 1, wherein the washing unit and the drying unit are installed in one casing.

5. The apparatus of claim 1, wherein the washing unit and the drying unit are respectively installed in a pair of casings.

6. The apparatus of claim 1, wherein at least one of the first and second airflow ducts consists of a soft material.

7. The apparatus of claim 1, wherein an airflow valve is installed at the first airflow duct for opening and closing the first airflow duct.

8. The apparatus of claim 1, wherein the first airflow duct is communicated with an upper side of the tub, and the second airflow duct is communicated with a lower side of the tub.

9. The apparatus of claim 1, wherein an airflow valve is installed at the second airflow duct for opening and closing the second airflow duct.

* * * * *